US006644663B2

(12) United States Patent
Seelig et al.

(10) Patent No.: US 6,644,663 B2
(45) Date of Patent: Nov. 11, 2003

(54) REEL MECHANISM

(75) Inventors: Jerald C. Seelig, Absecon, NJ (US); Lawrence M. Henshaw, Hammonton, NJ (US)

(73) Assignee: Atlantic City Coin & Slot Service Company Inc., Pleasantville, NJ (US)

( * ) Notice: Subject to any disclaimer, the term of this patent is extended or adjusted under 35 U.S.C. 154(b) by 0 days.

(21) Appl. No.: 09/968,952

(22) Filed: Oct. 1, 2001

(65) Prior Publication Data

US 2003/0094753 A1 May 22, 2003

(51) Int. Cl.[7] ..... G07F 17/34
(52) U.S. Cl. ..... 273/143 R; 463/20; 463/31
(58) Field of Search ..... 273/143 R, 138.2, 273/138.1; 463/20, 31

(56) References Cited

U.S. PATENT DOCUMENTS 462,284 A * 11/1891 Strobel ..... 273/143 R
592,763 A * 11/1897 Canda ..... 273/143 R
1,584,513 A * 5/1926 Davis et al. ..... 273/143 R
2,554,942 A * 5/1951 Dobrowsky ..... 273/143 R
3,565,441 A * 2/1971 Matsumoto ..... 273/143 R

* cited by examiner

*Primary Examiner*—Benjamin H. Layno
(74) *Attorney, Agent, or Firm*—Ian F. Burns & Associates; Ian F. Burns

(57) ABSTRACT

A reel mechanism for use with a gaming system that includes at least one support member and at least a first and second reel assembly attached to the support member. Each reel assembly comprises at least one chassis attached to the support member and at least one reel rotatably attached to the chassis. The reel includes a first side and a second side. The first side is attached to the chassis. The first and second reel assemblies are positioned side-by-side on the support member. The second sides of the reels of the reel assemblies are positioned proximately to each other. Another embodiment is disclosed that positions two reel assemblies at an angle relative to each other. This allows a portion of each reel to be adjacent to each other.

32 Claims, 9 Drawing Sheets

REEL MECHANISM

BACKGROUND OF THE INVENTION

1. Field of Invention

This invention relates to gaming devices and, more particularly, to a gaming device that utilizes a plurality of reels in close relative proximity.

2. Description of Related Art

Reel-type gaining devices have been used in gaming for more than one hundred years. Traditional reel-type gaming devices have three mechanical reels that rotate around a common horizontal axis. A reel strip is attached around the circumference of each reel and the reel strips display a plurality of symbols. During normal operation, the reels are spun and stopped to display an outcome of the game. As each reel comes to a stop, a symbol on the perimeter of each reel strip is displayed on the front of the gaming device. Some gaming devices indicate a winning outcome by aligning pre-determined symbols on one or more pre-determined pay lines.

Players of gaming devices typically find it enjoyable to have a variety of different forms of gaming apparatus available. Gaming devices that are more interesting, generate more player excitement and in turn are played longer resulting in more revenue for the game operator. For this purpose, gaming devices of the spinning reel type have been provided with a variety of different graphics, shapes, sound effects, and scoring systems. Some gaming devices have multiple pay lines such as additional horizontal pay lines, diagonal pay lines, and even V-shaped pay lines. The number of reels has increased beyond the basic three reel gaming devices. There are now slot machines with four reels, five reels, and even ten reels.

Gaming devices that display a plurality of partial or fragmented images have also been developed. When predetermined partial images are aligned, the partial images form a single image. Such a gaming device and method is described in co-pending patent application titled Image Alignment Gaming Device and Method, filed on Jun. 27, 2001, with application Ser. No. 09/894,197. In this type of gaming device, it is desirable to position reels closely together so that a player can easily form a whole image when two or more partial images are aligned. If there is a large gap between the reels, the player will have more difficulty forming a whole image from the partial images.

However, the prior art has failed to provide reel displays that have relatively small gaps or spaces between the reels. One of the reasons the reels are relatively far apart is that each reel is supported on one side by a chassis and space must be provided between the reels to accommodate the chassis. An example of such prior art gaming devices is disclosed in U.S. Pat. No. 5,580,055 issued to Hagiwara.

Thus, a current unmet need exists for a reel mechanism that minimizes the space between the reels. It is also desired that the reel mechanisms use presently available components. A current unmet need also exists for a method of altering existing gaming devices to produce contiguous indicia on their displays.

SUMMARY OF INVENTION

1. Advantages of the Invention

An advantage of the present invention is that it provides a reel mechanism that positions reel assemblies close together.

Another advantage of the present invention is that it provides a reel mechanism utilizing presently available components.

Another advantage of the present invention is that it provides a reel mechanism that produces contiguous indicia on the displays of gaming devices.

Another advantage of the present invention is that it provides a method for altering existing gaming devices to produce contiguous indicia on the displays of gaming devices without requiring significant redesigning and tooling.

Another advantage of the present invention is that it allows plurality of reel assemblies to be used to display a whole image from a plurality of partial images.

Another advantage of the present invention is that it allows a new class of designs to be displayed on the displays of gaming devices.

Another advantage of the present invention is that it provides a gaming device that adds to player excitement and satisfaction.

Another advantage of the present invention is that it provides a gaming device that is interesting to a player and results in longer playing time.

A further advantage of the present invention is that it provides a gaming device that is readily distinguishable from conventional slot machines.

These and other advantages of the present invention may be realized by reference to the remaining portions of the specification, claims, and abstract.

2. Brief Description of the Invention

The present invention comprises a reel mechanism for use with a gaming system that includes at least one support member and at least a first and second reel assembly attached to the support member. Each reel assembly comprises at least one chassis attached to the support member and at least one reel rotatably attached to the chassis. The reel includes a first side and a second side. The first side is attached to the chassis. The first and second reel assemblies are positioned side-by-side on the support member. The second side of the reel of the first reel assembly being positioned proximate to the second side of the reel of the second reel assembly.

The present invention further comprises a reel mechanism for use with a gaming system that includes at least one support member, at least a first chassis and a second chassis attached on the support member, and at least a first reel and a second reel. Each reel comprises a fastening side and a non-fastening side. Each side includes a circumferential edge. The fastening side of the first reel is rotatably attached to the first chassis. The fastening side of the second reel is rotatably attached to the second chassis. The second chassis is supported at an angle relative to the first chassis thereby causing a portion of the circumferential edge of the non-fastening side of the second reel to be proximate to a portion of the circumferential edge of the fastening side of the first reel.

The present invention also comprises a method of producing contiguous indicia on a gaming device. The method comprises the steps of providing at least a first and second reel assembly. Each reel assembly comprises at least one chassis and at least one reel rotatably attached to the chassis. The reel comprises a first and a second side. The first is attached to the chassis. The method further comprises the steps of positioning the first and second reel assemblies. The second side of the first reel assembly is positioned adjacent the second side of the second reel assembly. Indicia on the reels of the first and second reel assemblies are then displayed.

The present invention comprises another method of producing contiguous indicia on a gaming device. The method comprises the steps of providing at least a first chassis and a second chassis, providing at least a first providing at least a first reel and a second reel. Each reel comprises a fastening side and a non-fastening side. Each side of the reel has a circumferential edge. The method further includes the steps of attaching the fastening side of first reel to the first chassis and the fastening side of the second reel to the second chassis and positioning the non-fastening side of the second reel at an angle relative to the fastening side of the first reel causing the circumferential edge of the non-fastening side of the second reel to be proximate to the circumferential edge of the fastening side of the first reel.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Gaming Device

Figure 1:
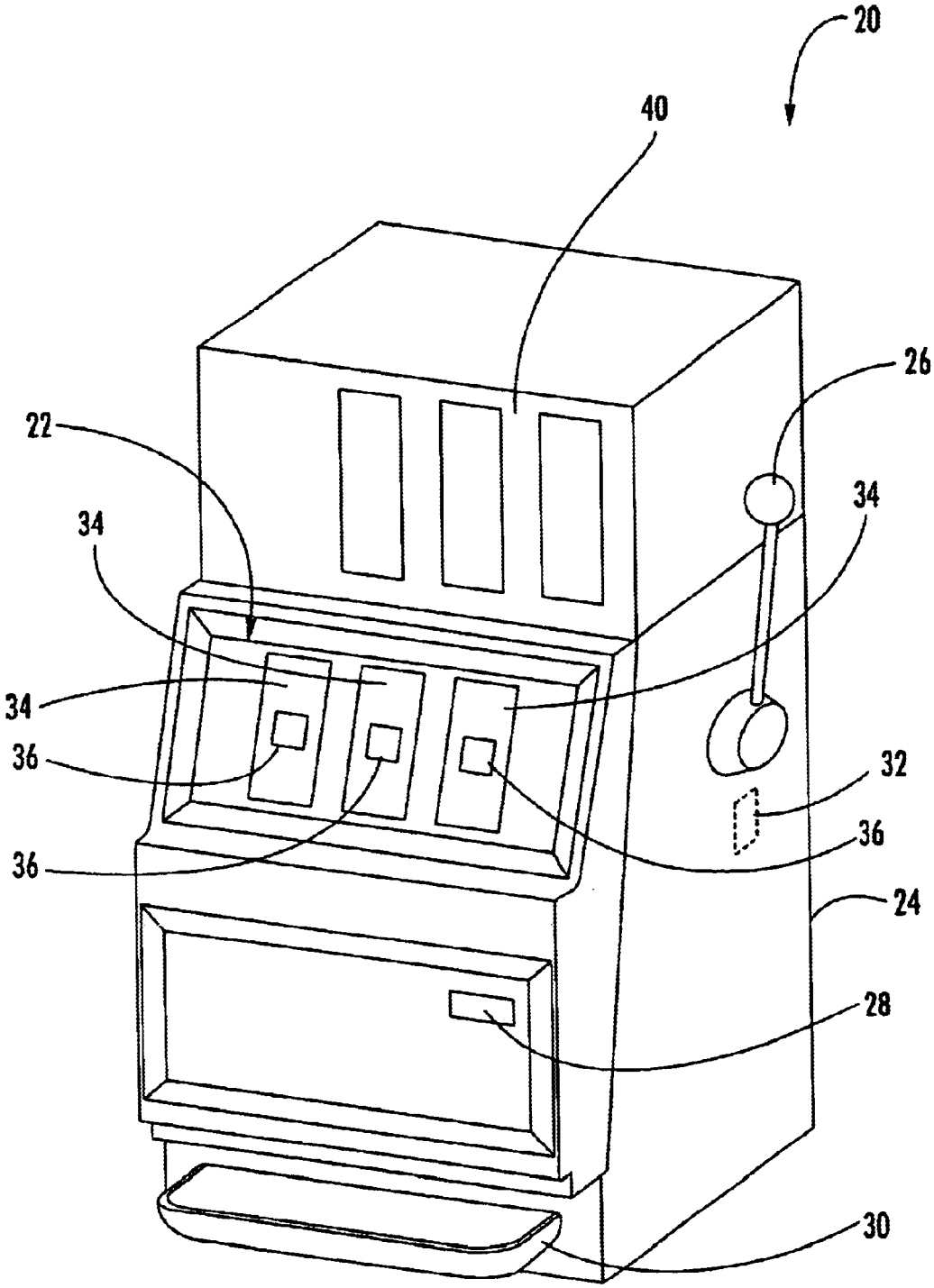
FIG. 1 PRIOR ART
FIG. 1 is substantially an isometric view of a prior art gaming device that utilizes a spinning reel display.

The present invention comprises a reel mechanism for use with a gaming device. FIG. 1 illustrates a prior art reel-type gaming device 20. Gaming device 20 may comprise a case 24, a reel-type game display 22 having a plurality of display sections 34, a handle 26, a currency acceptor 28, a coin bin 30, and a game controller 32.

The display 22 of the gaming device in FIG. 1 comprises three display sections 34. While display 22 is shown with three display sections, more or less sections may be used. For example, a 3×3 matrix of 9 display sections could be used. A payline (not shown) may be added to the display to aid the player in seeing the alignment of the fractional images. It is noted that display sections 34 of gaming device 20 are spaced apart. This characteristic limits the display capabilities of the gaming device. For example, it is more difficult to use gaming device 20 to display a whole image from a plurality of partial images, the partial images being in different sections 34.

Case 24 contains gaming device components. A wager acceptor 28 accepts wagers from a game player. The wager acceptor may also accept tokens, paper currency, magnetic cards, and vouchers. A coin bin 30 holds coins that are dispensed after a winning event has occurred. Handle 26 is used by the game player to initiate play on gaming device 20. Handle 26 is pulled by the game player to start the game. Other input devices, such as a button, may also be provided for initiating play.

Reels 38 (seen in FIG. 4) spin or rotate around a common axis. When controller 32 determines that a game-winning event has occurred, the controller causes reels 38 to display the appropriate symbols or indicia 36 in sections 34. The combination or arrangement of symbols 36 corresponds to a display on paytable 40. The player is then awarded a prize.

Reel Assemblies

Figure 2:
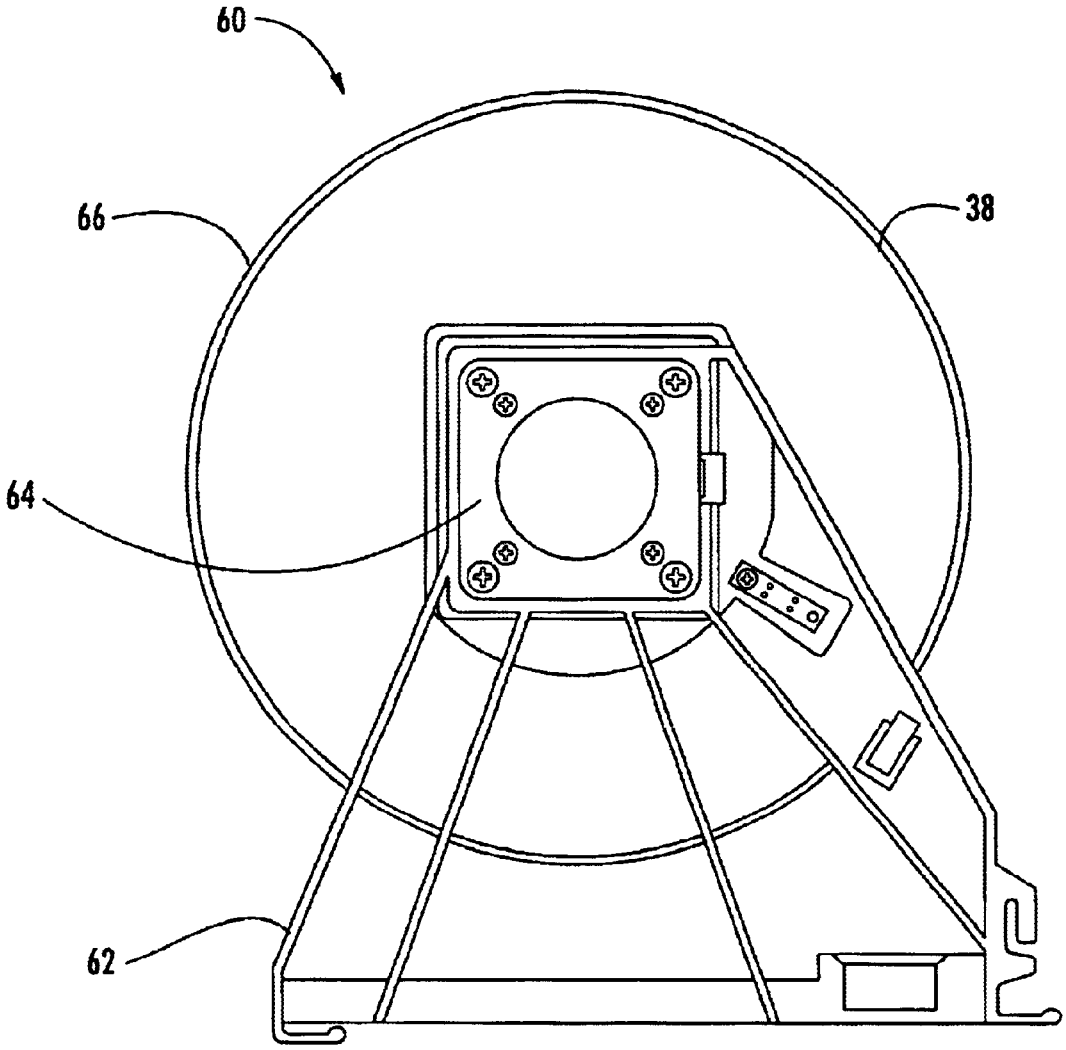
FIG. 2 PRIOR ART
FIG. 2 is substantially a side view of a typical prior art reel assembly.

FIG. 2 shows a prior art reel assembly 60 that may be a large number of reel assemblies that are well known in the art, including S-plus reel assemblies manufactured by International Game Technologies in Reno, Nev. Reel assembly 60 comprises a chassis 62 and a reel 38 rotatably attached to the chassis. A reel motor 64 may also be provided on chassis 62 for rotating the reel. The reel motor 64 is typically connected to a controller (not shown) to controllably stop the reel rotation. The reel 38 comprises a cylindrical structure with a circumference 66. The reel 38 and chassis 62 are typically made of an injection-molded polymer or steel.

Figure 3:
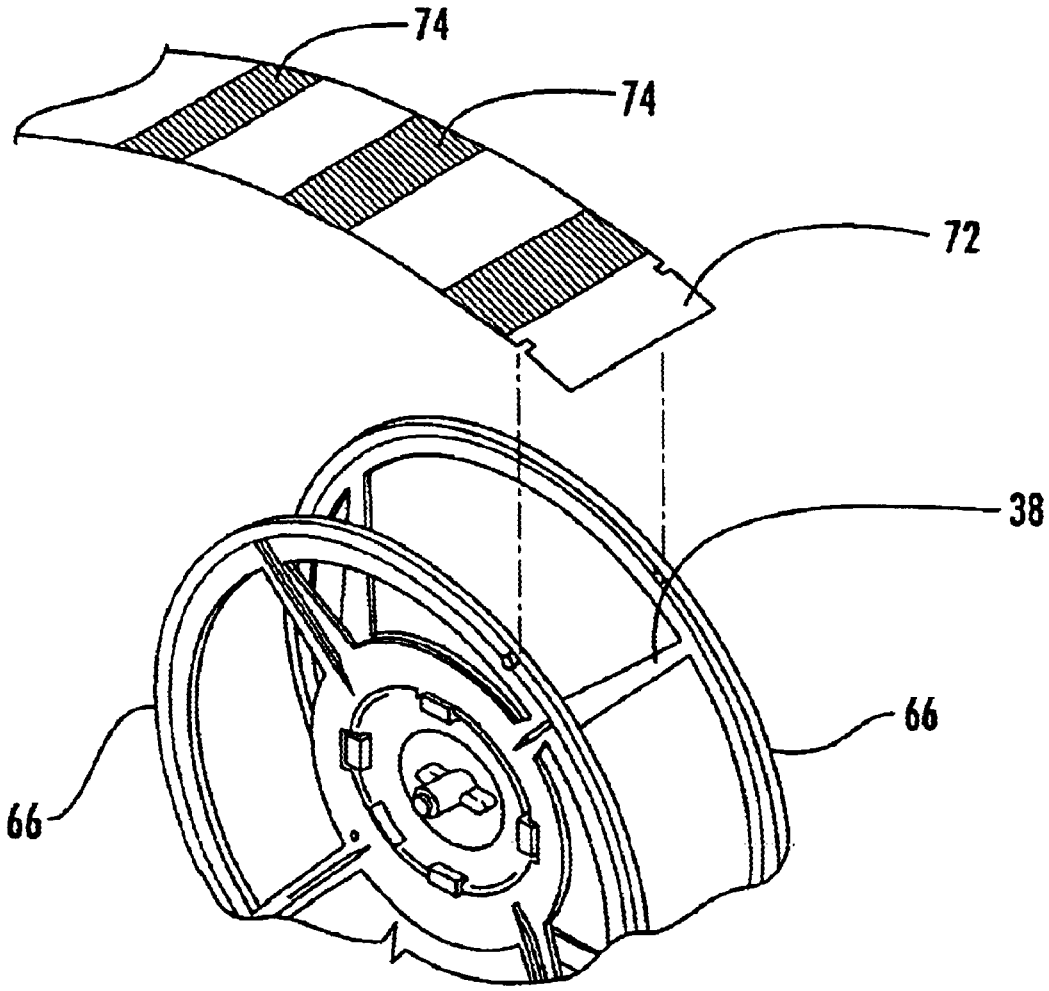
FIG. 3 PRIOR ART
FIG. 3 is substantially a side view of a reel with a detached media strip.

FIG. 3 shows a reel assembly further comprising a media strip 72 attached to circumference 66. The media strip 72 comprises sections 74 of various types of fractional images.

Figure 4:
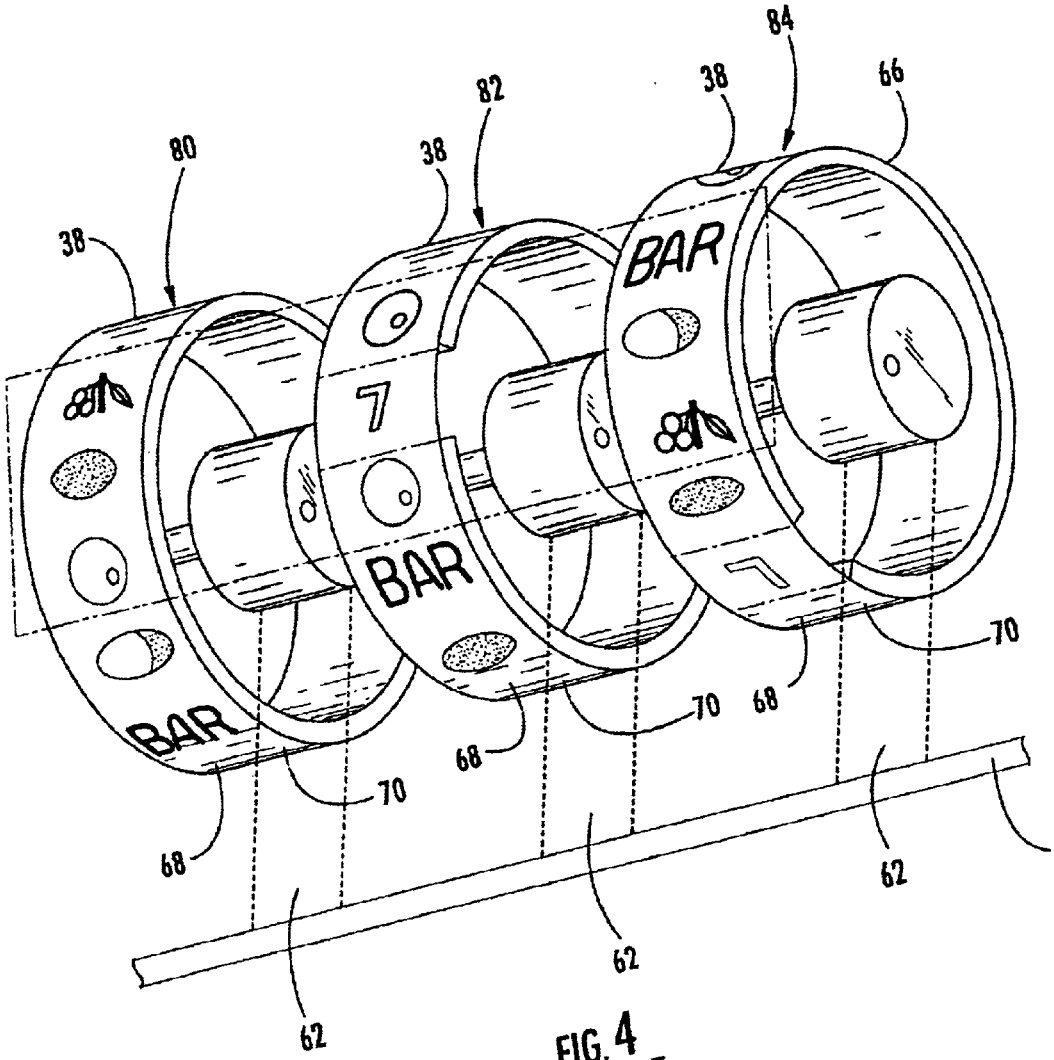
FIG. 4 PRIOR ART
FIG. 4 is substantially a perspective view of a prior art reel mechanism wherein the reel assemblies are positioned side-by-side on the support member and the chassis of the individual assemblies are in between the reels of the reel assemblies.

FIG. 4 shows a typical prior art reel mechanism having first 80, second 82, and third 84 substantially similar reel assemblies attached side-by-side on a support member 76. The reel assemblies 80, 82, and 84 are uniformly positioned on support member 76. The support member 76 is typically made of an injection-molded polymer. Alternatively, the support member 76 can be made of steel or wood. Each reel assembly 80, 82, and 84 comprises a reel 38 and a chassis 62. Each reel 38 comprises a first side 70 and a second side 68 with chassis 62 being attached to the second side 68.

Chassis 62 of first assembly 80 is positioned between first side 70 of first reel assembly 80 and second side 68 of second reel assembly 82. Chassis 62 of the second assembly 82 is positioned in between first side 70 of the second reel assembly 82 and second side 68 of third assembly 84. Space must be provided between reel assemblies to accommodate chassis 62. This causes reels 38 to be separated from each other by a certain distance. As a result, what a game player sees from the display sections of the gaming device is a series of fractional images that is non-contiguous.

Opposing Reel Assemblies

Figure 5:
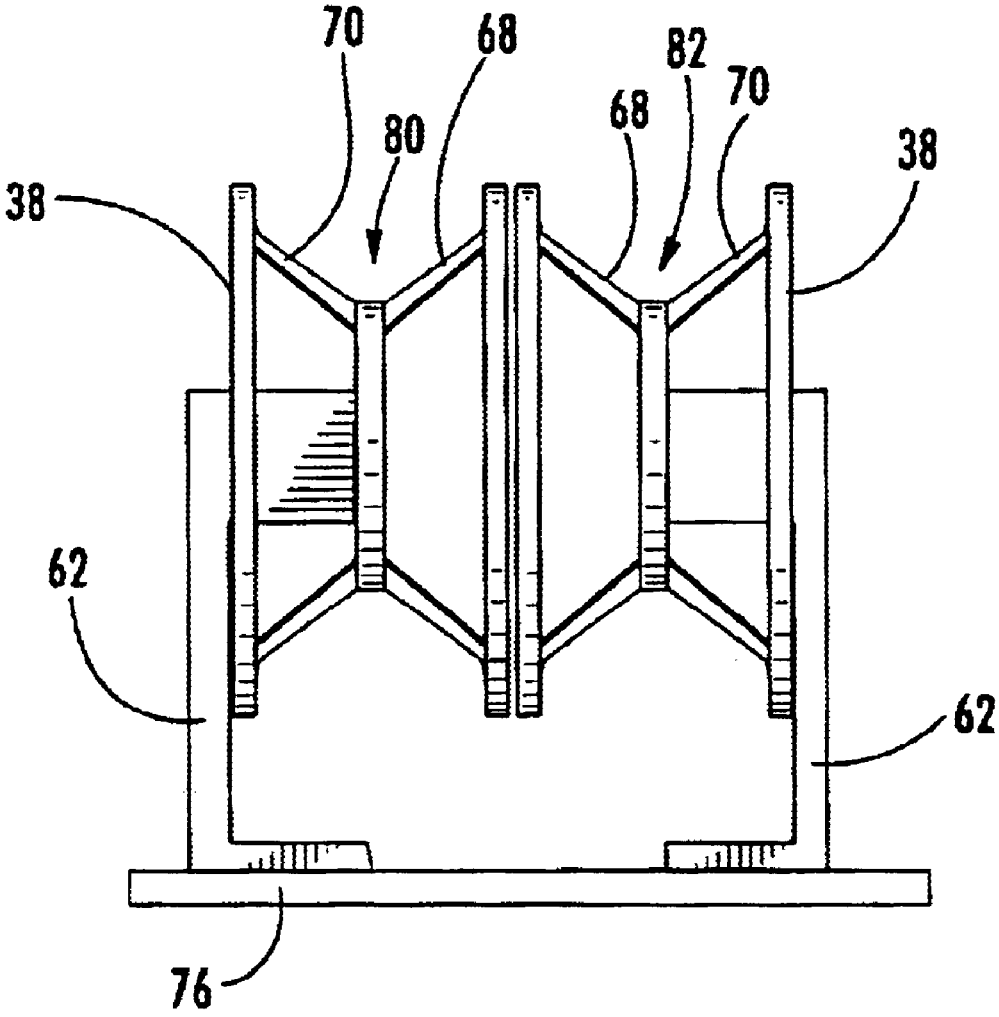
FIG. 5 is substantially a front elevational front view of one of the embodiments of the present invention.

FIG. 5 shows one embodiment of the present invention comprising at least one support member 76 and at least a first reel assembly 80 and second reel assembly 82 attached to the support member. Each reel assembly comprises at least one chassis 62 attached to the support member and at least one reel 38 rotatably attached to the chassis 62. The reel comprises a first side or fastening side 70 and a second side or non-fastening side 68, the first side 70 being attached to the chassis 62. First reel assembly 80 and second reel assembly 82 are positioned side-by-side in an opposing relationship. Second side 68 of reel 38 of the first reel assembly 80 is positioned proximate or adjacent to second side 68 of reel 38 of second reel assembly 82. In the preferred embodiment, the opposing reel assemblies are vertically aligned. In another preferred embodiment, the opposing reel assemblies are horizontally aligned. In other embodiments, the opposing reel assemblies can be diagonally aligned or aligned other ways.

It is noted that this embodiment configures the reel assemblies so that the chassis of each reel assembly is peripherally positioned rather than centrally positioned between the reel assemblies as in the prior art. As a result, the gap between the reel assemblies is substantially reduced and a player can more easily form a whole image from a plurality of fractional images on different reels. Additionally, the reel configuration allows for more display opportunities. Whole images, such as an image of a person, place, or an object, can be displayed on the gaming device by dividing the whole image into fractional images. When the fractional images from each reel are aligned, the game player will see a contiguous whole image from the display section of the gaming apparatus.

Angularly Supported Reel Assembly

Figure 6:
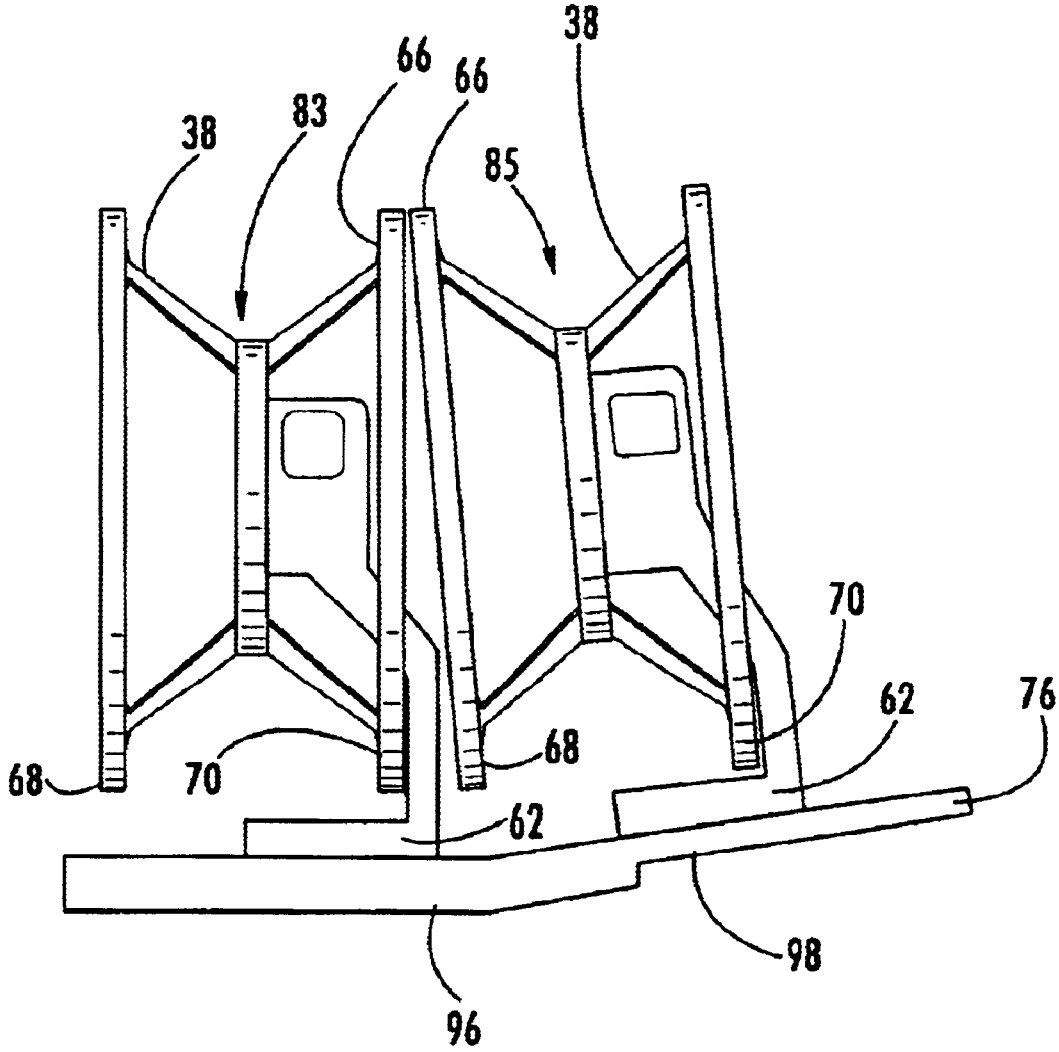
FIG. 6 is substantially a front elevational front view of another embodiment of the present invention.

FIG. 6 shows another embodiment of the present invention comprising at least one support member 76, a first reel assembly 83 and a second reel assembly 85. Each reel assembly comprises a reel 38 with a first side 70 and a second side 68 and a chassis 62 rotatably attached to the first side 68. In this embodiment, reel assembly 85 is angularly mounted so that a portion of second side 68 of second reel assembly 85 is proximate or adjacent to first side 70 of reel assembly 83. This may also be expressed in terms of axes of rotation. Each reel 38 rotates around an axis. In this embodiment, the axes of rotation are nonparallel. This angular relationship allows chassis 62 of the first reel assembly 83 to be positioned between reels 38. The magnitude of the angle between first reel assembly 83 and second reel assembly 85 depends on the size of the reels and the thickness of chassis 62. In order to minimize the angle and make the angle less noticeable to players, it is desirable to utilize large diameter reels and a narrow chassis.

Figure 7:
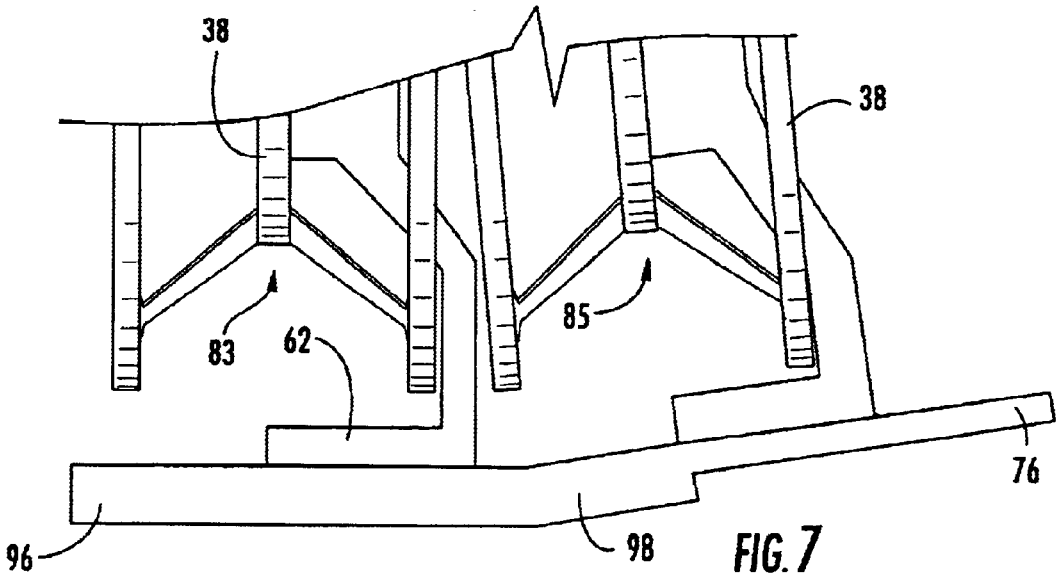
FIG. 7 is substantially a detailed elevational view of a portion of the support member in one embodiment of the present invention.
Figure 8:
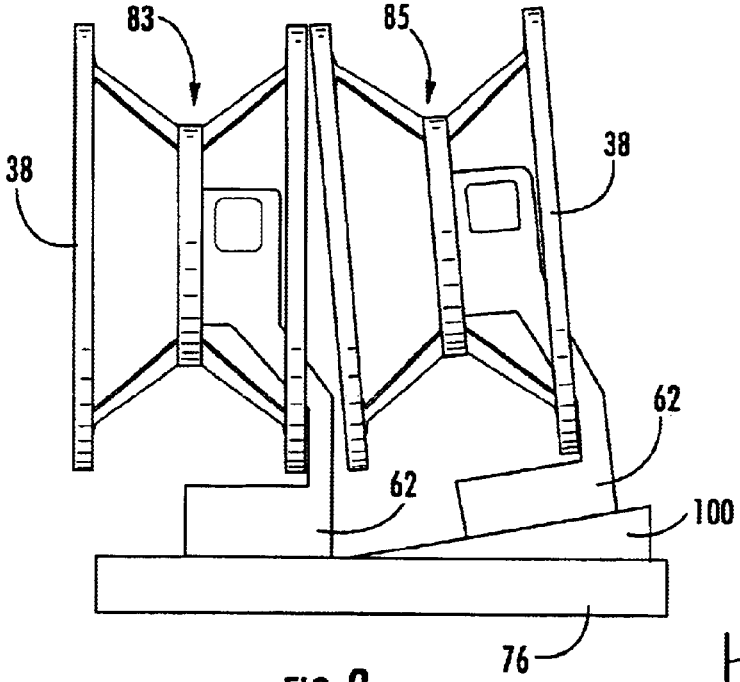
FIG. 8 is substantially a front elevational view of another embodiment of the present invention.
Figure 11:
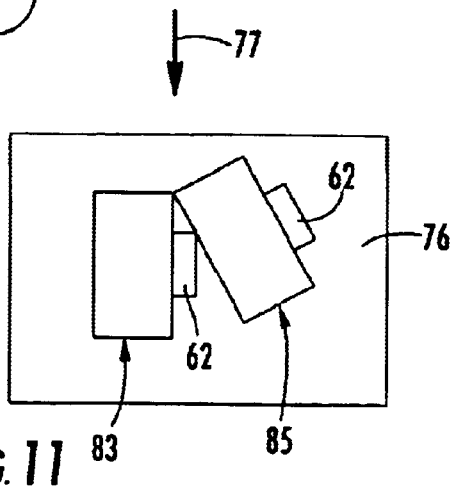
FIG. 11 is substantially a top view of another embodiment of the present invention.

Second reel assembly 85 may be angularly supported in a number of different ways. As seen in FIGS. 6 and 7, support member 76 may comprise a first surface 96 and a second surface 98 that are joined by a bent section, the first surface being nonparallel to the second surface. First reel assembly 83 is attached to first section 96 and second reel assembly 85 is attached to second section 98, thereby creating a nonparallel relationship between the two reel assemblies. In an alternative embodiment (not shown), two support members may be used that have nonparallel surfaces for mounting the first and second reel assemblies. Referring to FIG. 8, the present invention may also comprise a wedge 100 mounted between chassis 62 of second reel assembly 85 and support member 76. Referring FIG. 11, support member 76 may have a substantially planar surface and first and second reel assemblies 83 and 85 are mounted at an angle relative to each other on the surface. In this embodiment, a player would view the reel assemblies from the direction of arrow 77. In the preferred embodiment, the angularly supported reel assemblies are vertically aligned. In another preferred embodiment, the angularly supported reel assemblies are horizontally aligned. In other embodiments, the angularly supported reel assemblies can be diagonally aligned or aligned other ways.

Combined Opposing and Angularly Supported Reel Assemblies

Figure 9:
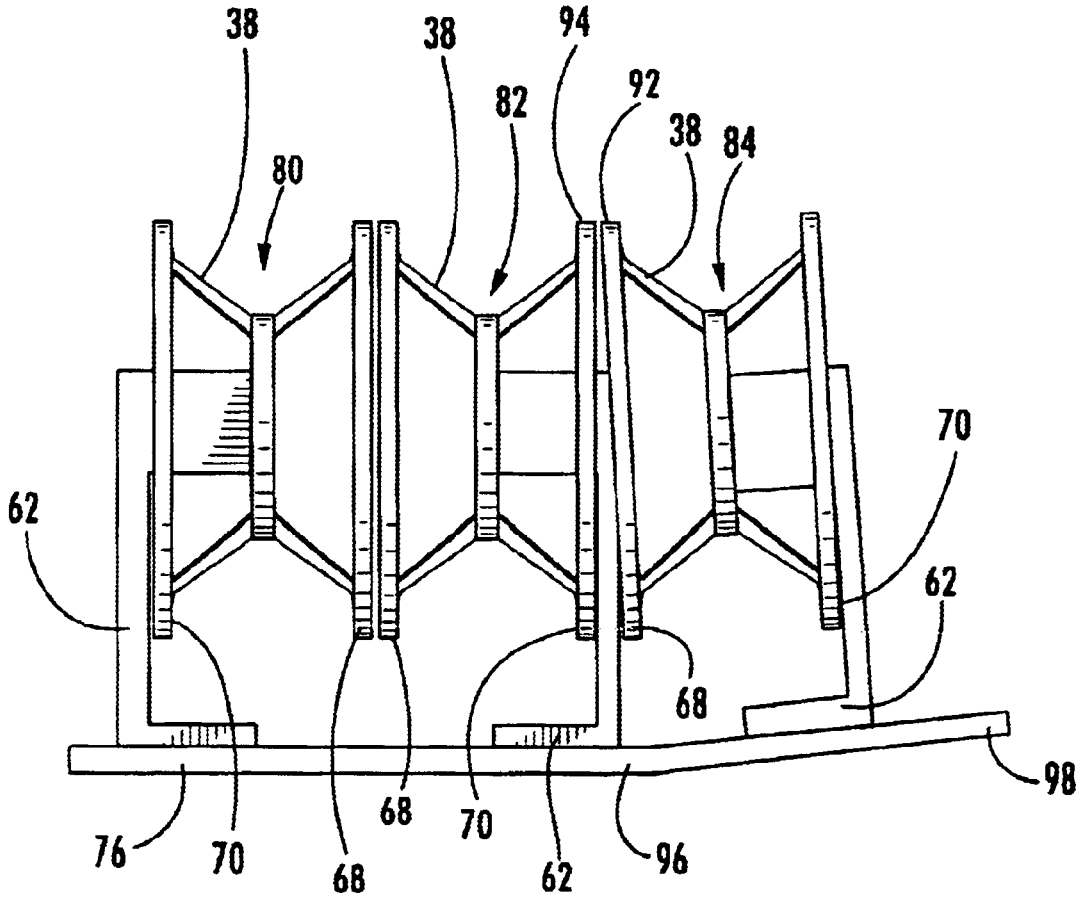
FIG. 9 is substantially a front elevational view of the preferred embodiment of the present invention.

In the preferred embodiment, as shown in FIG. 9, the present invention comprises a reel mechanism with three reel assemblies 80, 82, and 84. Each reel assembly comprises a reel 38 with a first side 70, a second side 68 side and a chassis 62 rotatably attached to the first side of the reel. First reel assembly 80 is mounted to support member 76 in an opposing relationship to second reel assembly 82, wherein second side 68 of the first reel assembly is proximate or adjacent to second side 68 of the second reel assembly. Third reel assembly 84 is angularly supported relative to second reel assembly 82, wherein a portion 94 of first side 70 of second reel assembly 82 is proximate or adjacent to a portion 82 second side 68 of third reel assembly 84. A four reel assembly (not shown) could be added to this embodiment by angularly supporting a reel assembly next to the first side 70 of first reel assembly 80. In the preferred embodiment, the combined opposing and angularly supported reel assemblies are vertically aligned. In another preferred embodiment, the combined opposing and angularly supported reel assemblies are horizontally aligned. In other embodiments, the combined opposing and angularly supported reel assemblies can be diagonally aligned or aligned other ways.

Figure 10:
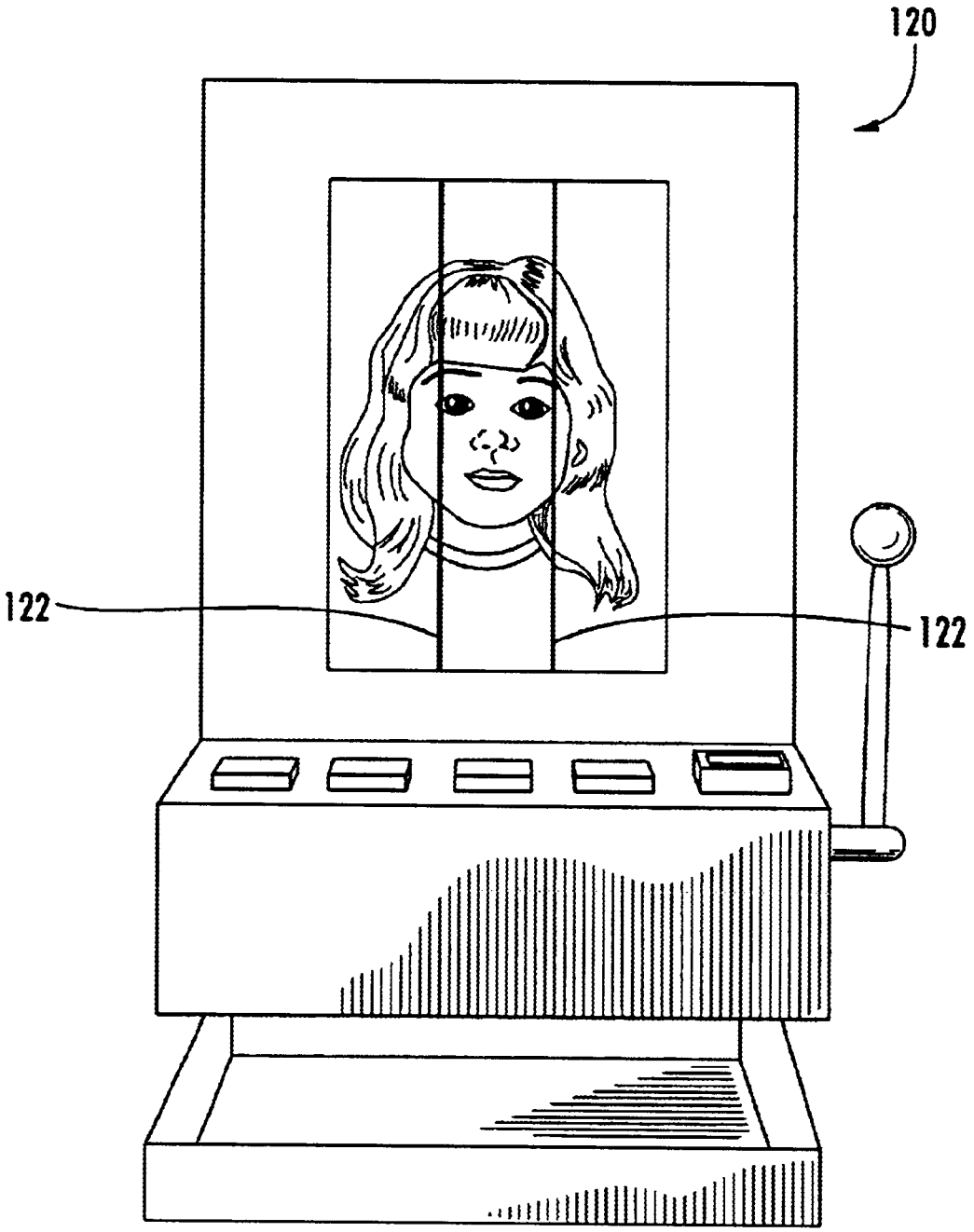
FIG. 10 is substantially a front view of a reel display of the present invention.

FIG. 10 illustrates the reel mechanism of the present invention utilized with a gaming device 120. Gaps 122 between reels 38 are substantially eliminated. A player is able to more easily form a whole image from a plurality of fractional images. Additionally, the preferred embodiment allows for even more display opportunities. Larger, more vivid, and realistic images can be displayed on a gaming device because the preferred embodiment allows for more reel assemblies to be positioned side-by-side. A large image, for instance an image of a person, may be divided into fractional images, which can be printed on the media strips of the individual reels of the plurality of reel assemblies. When the fractional images from each reel are aligned, the game player will see a contiguous whole image from the display section of the gaming apparatus.

CONCLUSION

The present invention solves many problems associated with the prior art and fulfills many currently unmet needs.

The present invention provides a reel mechanism that produces contiguous indicia on the displays of gaming devices while utilizing the components present in currently existing reel slot machines. The present invention also provides a method for altering existing gaming devices to produce contiguous indicia on the displays of gaming devices without requiring significant redesigning and tooling. The present invention also allows whole images to be realistically displayed on the displays of gaming devices and the present invention provides a gaming device that adds to player excitement and satisfaction.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A reel mechanism for use with a gaming system, comprising:

(A) at least one support member; and (B) at least a first and second reel assembly attached to the support member, each reel assembly comprising:

(a) at least one chassis attached to the support member; and (b) at least one reel rotatably attached to the chassis, the reel comprising a first side and a second side, the first side being attached to the chassis;

(b) at least one motor coupled to the reel, the motor being configured to rotate the reel; and wherein the first and second reel assemblies are positioned side-by-side, the second side of the reel of the first reel assembly being positioned proximate to the second side of the reel of the second reel assembly the chassis of the first reel assembly being positioned opposite the chassis of the second reel assembly thereby preventing the chassis of the first and second reel assemblies from obstructing a front view of an area substantially between the reels of the first and the second reel assemblies.

2. The reel mechanism according to claim 1, further comprising a third reel assembly, the third reel assembly comprising:

(A) a least one chassis attached to the support member;

(B) at least one reel, the reel comprising a first side and a second side, the first side being rotatably attached to the chassis;

wherein the third reel assembly is positioned at an angle relative to the second reel assembly causing a section of the reel of the third reel assembly to be proximate to a section of the reel of the second reel assembly.

3. The reel mechanism according to claim 2, wherein the support member comprises a first and second section, the first section forms an angle with the second section, the chassis of the second reel assembly being attached to the first section and the chassis of the third reel assembly being attached to the second section, wherein the third reel assembly is positioned at an angle relative to the second reel assembly.

4. The reel mechanism according to claim 2, wherein the third reel assembly further comprises a wedge positioned between the chassis of the third reel assembly and the support member, wherein the third reel assembly is positioned at an angle relative to the second reel assembly.

5. The reel mechanism according to claim 2, further comprising at least one fractional image on the reel of the second reel assembly and the reel of the third reel assembly, wherein the fractional images form a whole image when the fractional images are aligned.

6. The reel mechanism according to claim 2 further comprising at least one fractional image on the reel of the first reel assembly, the reel of the second reel assembly, and the reel of the third reel assembly, wherein the fractional images form a whole image when the fractional images are aligned.

7. The reel mechanism of claim 2, wherein the first, second, and third reel assemblies are aligned vertically.

8. The reel mechanism according to claim 1, further comprising at least one fractional image on the reel of the first reel assembly and the reel of the second reel assembly, wherein the fractional images form a whole image when the fractional images are aligned.

9. The reel mechanism of claim 1, wherein the first and second reel assemblies are aligned vertically.

10. A reel mechanism for use with a gaining system, comprising:

(A) at least one support member;

(B) at least a first chassis and a second chassis attached on the support member; and (C) at least a first reel and a second reel, each reel comprising a fastening side and a non-fastening side, each side having a circumferential edge, the fastening side of the first reel being rotatably attached to the first chassis, the fastening side of the second reel being rotatably attached to the second chassis;

wherein the second chassis is supported at an angle relative to the first chassis thereby causing a portion of the circumferential edge of the non-fastening side of the second reel to be proximate to a portion of the circumferential edge of the fastening side of the fist reel.

11. The reel mechanism according to claim 10, wherein the support member comprises a first and second surface, the first surface being nonparallel with the second surface, the first chassis being attached to the first section and the second chassis being attached to the second section.

12. The reel mechanism according to claim 10, further comprising a wedge positioned between the second chassis and the support member.

13. The reel mechanism according to claim 10, further comprising (A) a third chassis; and (B) a third reel comprising a fastening side and a non-fastening side, the fastening side being rotatably attached to the third chassis;

wherein the third reel is positioned in an opposing relationship to the first reel, the non-fastening sides of the first and third reels being proximate to each other.

14. The reel mechanism in claim 13, further comprising a first fractional image on the first reel, a second fractional image on the second reel, and a third fractional image on the third reel, wherein a player may see a whole image when the first, second, and third fractional images are aligned.

15. The reel mechanism in claim 13, further comprising a first image on the first reel, a second image on the second reel, and a third image on the third reel, wherein a player may see a fourth image when the first, second and third images are aligned.

16. The reel mechanism of claim 13, wherein the first, second, and third reels are vertically aligned.

17. The reel mechanism in claim 10, farther comprising a first fractional image on the first reel and a second fractional image on the second reel, wherein a player may see a whole image when the first and second fractional images are aligned.

18. The reel mechanism of claim 10, wherein the first and second reels are vertically aligned.

19. A method of producing contiguous indicia on a gaming device, the method comprising the steps of:

(A) providing at least a first and second reel assembly within a gaming device housing, each reel assembly comprising:

at least one chassis, at least one reel rotatably attached to the chassis, the reel comprising a first side and a second side, the first side being attached to the chassis; and a motor coupled to the reel and configured to rotate the reel;

(B) positioning the first and second reel assemblies, wherein the second side of the first reel assembly is adjacent the second side of the second reel assembly the chassis of the first reel assembly being positioned opposite the chassis of the second reel assembly thereby preventing the chassis of the first and second reel assemblies from obstructing a front view of an area substantially between the reels of the first and the second reel assemblies; and (C) displaying indicia on the reels of the first and second reel assemblies.

20. The method of claim 19, further comprising the steps of:

(A) providing a third reel assembly, the third assembly comprising at least one chassis and at least one reel, the reel comprising a first side and a second side, the first side being rotatably attached to the chassis;

(B) positioning the third reel assembly at an angle relative to the second reel assembly, wherein a section of the reel of the third red assembly is proximate to the a section of the reel of the second reel assembly; and (C) displaying indicia on the reel of the third reel assembly.

21. The method of claim 20, wherein positioning the third reel, assembly at an angle relative to the second reel assembly comprises:

(A) providing a support member with a first surface and a second surface, the first surface being non-parallel with the second surface; and (B) attaching the second reel assembly to the first surface arid the third reel assembly to the second surface.

22. The method of claim 20, wherein positioning the third reel assembly at an angle relative to the second reel assembly comprises:

(A) providing a wedge and a support member, the support member being substantially planar;

(B) supporting the second reel assembly from the support member; and (C) supporting the third reel assembly from the support member, the wedge being positioned between the chassis of the third reel assembly and the support member.

23. The method of claim 20 further comprising:

(A) providing at least one fractional image on the reel of the second reel assembly and the reel of the third reel assembly; and (B) aligning the fractional image of the second reel assembly with the fractional image of the third reel assembly.

24. The method of claim 20 further comprising:

(A) providing at least one fractional image on the reel of the first assembly, the reel of the second reel assembly, and the reel of the third reel assembly; and (B) aligning the fractional images of the first, second, and third reel assemblies.

25. The method of claim 19 further comprising:

(A) providing at least one fractional image on the reel of the first reel assembly and the reel of the second reel assembly; and (B) aligning the fractional image of the first reel assembly with the fractional image of the second reel assembly.

26. A method of producing contiguous indicia on a gaming device, comprising:

(A) providing at least a first chassis and a second chassis;

(B) providing at least a first reel and a second reel, each reel comprising a fastening side and a non-fastening side; each side of the reel having a circumferential edge;

(C) attaching the fastening side of first reel to the first chassis and the fastening side of the second reel to the second chassis; and (D) positioning the non-fastening side of the second reel at an angle relative to the fastening side of the first reel causing the circumferential edge of the non-fastening side of the second reel to be proximate to the circumferential edge of the fastening side of the first reel.

27. The method of claim 26 wherein positioning the non-fastening side of the second reel at an angle relative to the fastening side of the first reel comprises:

(A) providing a first and second section in the support member, wherein the first section forms an angle with the second section; and (B) attaching the first chassis to first section of the support member and the second chassis to the second section of the support member.

28. The method of claim 26, wherein positioning the non-fastening side of the second reel at an angle relative to the fastening side of the first reel comprises:

(A) providing a support member;

(B) providing a wedge;

(C) attaching the first chassis to the support member;

(D) attaching the wedge to the support member; and (E) attaching the second chassis to the wedge.

29. The method of claim 26, further comprising:

(A) providing a third chassis;

(B)providing a third reel, the third reel comprising a fastening side and a non-fastening side, the fastening side being attached to the third chassis; and (C) positioning the third reel adjacent to the first reel, the non-fastening sides of the first and third reels being apposed and proximate each other.

30. The method of claim 29, further comprising:

(A) providing a fractional image on the first reel;

(B) providing a fractional image on the third reel; and (C) aligning the fractional image on the first reel with the fractional image on the third reel.

31. The method of claim 29, further comprising:

(A)providing a fractional image on the first reel;

(B)providing a fractional image on the second reel;

(C) providing a fractional image on the third reel; and (C)) aligning the fractional images on the first, second, and third reels.

32. The method of claim 29, further comprising:

(A) providing a fractional image on the first reel;

(B) providing a fractional image on the second reel; and (C) aligning the fractional image on the first reel with the fractional image on the second reel.

* * * * *